US005080271A

United States Patent [19]

Chen

[11] Patent Number: 5,080,271

[45] Date of Patent: Jan. 14, 1992

[54] AUTOMATIC AMPOULE CUTTER

[76] Inventor: I-Cheng Chen, 2Fl., No. 6, Alley 8, Szewei Lane, Chungcheng Road, Hsin-Tien City, Taipei Hsien, Taiwan

[21] Appl. No.: 580,183

[22] Filed: Sep. 10, 1990

[51] Int. Cl.[5] ..... B26F 3/00

[52] U.S. Cl. ..... 225/96.5; 225/103

[58] Field of Search ..... 225/96.5, 103, 105

[56] References Cited

U.S. PATENT DOCUMENTS

| | | | |
|---|---|---|---|
| 2,362,115 | 11/1944 | Cline | 225/96.5 |
| 2,878,619 | 3/1959 | Van Steyn | 225/96.5 |
| 3,692,220 | 9/1972 | Seng | 225/96.5 |
| 4,105,150 | 8/1978 | Insolio | 225/96.5 |
| 4,417,679 | 11/1983 | Shields | 225/96.5 |
| 4,805,821 | 2/1989 | Kowalczyk et al. | 225/96.5 |

*Primary Examiner*—Mark Rosenbaum

*Assistant Examiner*—Rinaldi Rada

[57] ABSTRACT

An automatic ampoule cutter including a driving device, cutter mechanism having a cutting member, a fixing member and a clamping member, a slant board, a collector and a fan, whereby when an ampoule is placed into the cutter mechanism, a micro switch is touched and activated by the ampoule to make the driving device drive the cutter mechanism, urging the cutting member, fixing member and clamping member to tightly clamp the ampoule, permitting the cutting member to rotate for several turns and cut a groove on the neck of the ampoule so that a knocking member can knock off the conic head to roll down on the slant board into the collector, and the cutting chips is blown by the fan also into the collector, and when the left ampoule is taken out to leave the micro switch, the operation of the cutter then stops.

1 Claim, 7 Drawing Sheets

AUTOMATIC AMPOULE CUTTER

BACKGROUND OF THE INVENTION

The present invention relates to an automatic ampoule cutter, and more particularly to an automatic ampoule cutter with high security.

At present time, an ampoule containing liquid drug used in a hospital is often cut by a cutter made from a kind of hard stone or metal, having a blade or saw portion.

The ampoule is often cut in such a manner that the cutter is applied to sand the neck of the ampoule to cut a groove thereon, and then the ampoule can be manually broken off into two. As a result, two openings with sharp and irregular periphery are respectively formed on the left ampoule and the discard head thereof.

Consequently, the sharp and irregular openings often cause serious injury to a medical worker. Another type of glass ampoule with precut groove is also on the market. Such ampoule is also apt to be formed with irregular sharp opening after broken off, and is still dangerous to the medical worker.

Moreover, the glass chips produced during cutting and breaking procedure are so easy to drop into the ampoule and mix with the liquid drug. As a result, the glass chips are quite apt to be injected into a patient's body along with the liquid drug and therefore do unexpected hurt to the patient.

SUMMARY OF THE INVENTION

It is therefore a primary object of this invention to provide an automatic ampoule-cutter with high security wherein no opening with irregular saw periphery will be formed on the broken ampoule.

It is a further object of this invention to provide the above ampoule-cutter wherein the glass discards are collected into a collector without bounding or dropping out and thus the possible hurt to a medical worker or cleaner can be avoided.

It is still a further object of this invention to provide the above ampoule-cutter wherein a user only needs to place the ampoule into the cutter and take the same out after completion of the cutting procedure, and no more need to break the ampoule with both two hands. As a result, the injury to the worker can be reduced to a minimum degree, and the safety of the worker can be ensured.

It is still a further object of this invention to provide the above ampoule-cutter which occupies small room and can be conveniently located at any place for a user to apply.

The present invention can be best understood through the following description with reference to accompanying drawings wherein:

DETAILED DESCRIPTION OF THE PREFERRED EMBODIMENT

Figure 1:
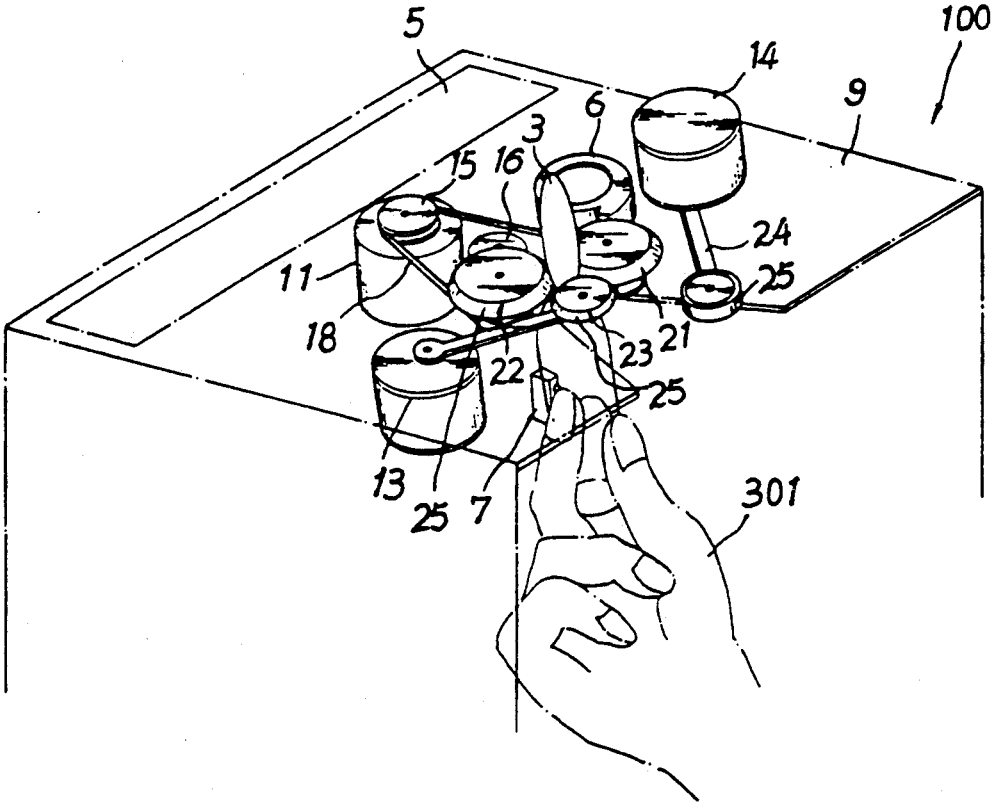
FIG. 1 is a perspective view of the automatic ampoule-cutter of this invention.
Figure 2:
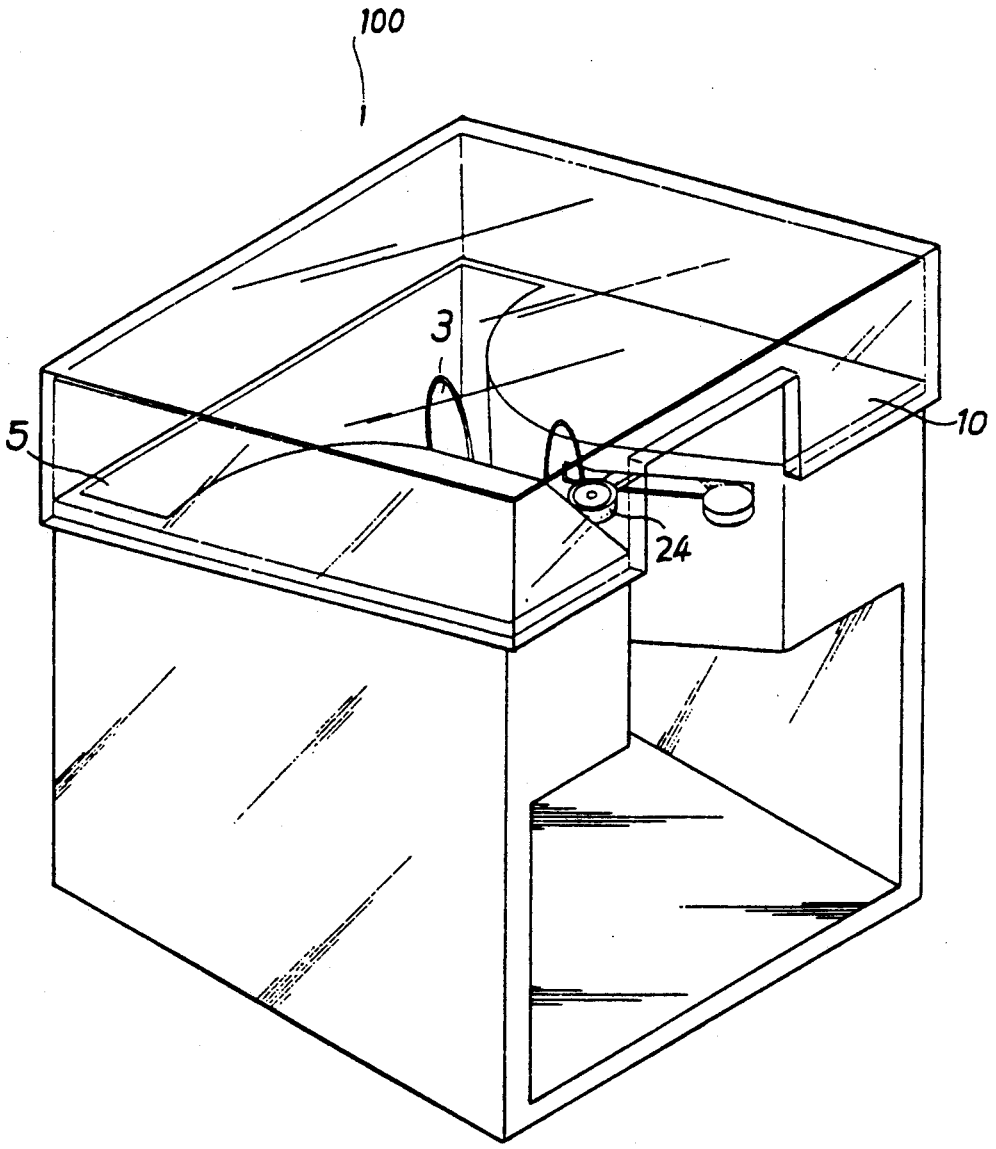
FIG. 2 shows a knocking state of the automatic ampoule-cutter.

Please first refer to FIGS. 1 and 2, wherein when a ampoule 3 is placed by a hand 301 into a cutter mechanism 2, a micro switch 7 is touched and activated to make the cutter 100 of this invention operate. At this time, a power indicator 71 is lighted, and a clamping member 23 automatically tightly clamps the ampoule 3 to fix the same. The cutter mechanism 2 then rotates for several turns to cut the ampoule 3. Thereafter, a knocking member 24 will automatically knock off the upper portion of the already cut ampoule 3. When the cutting operation is completed, a "bi-bi" sound is emitted from a buzzer (not shown) which may be provided by modifying the present invention to indicate the completion of the cutting operation. At this time, the lower portion of the ampoule 3 with an opening can be taken out.

Figure 3:
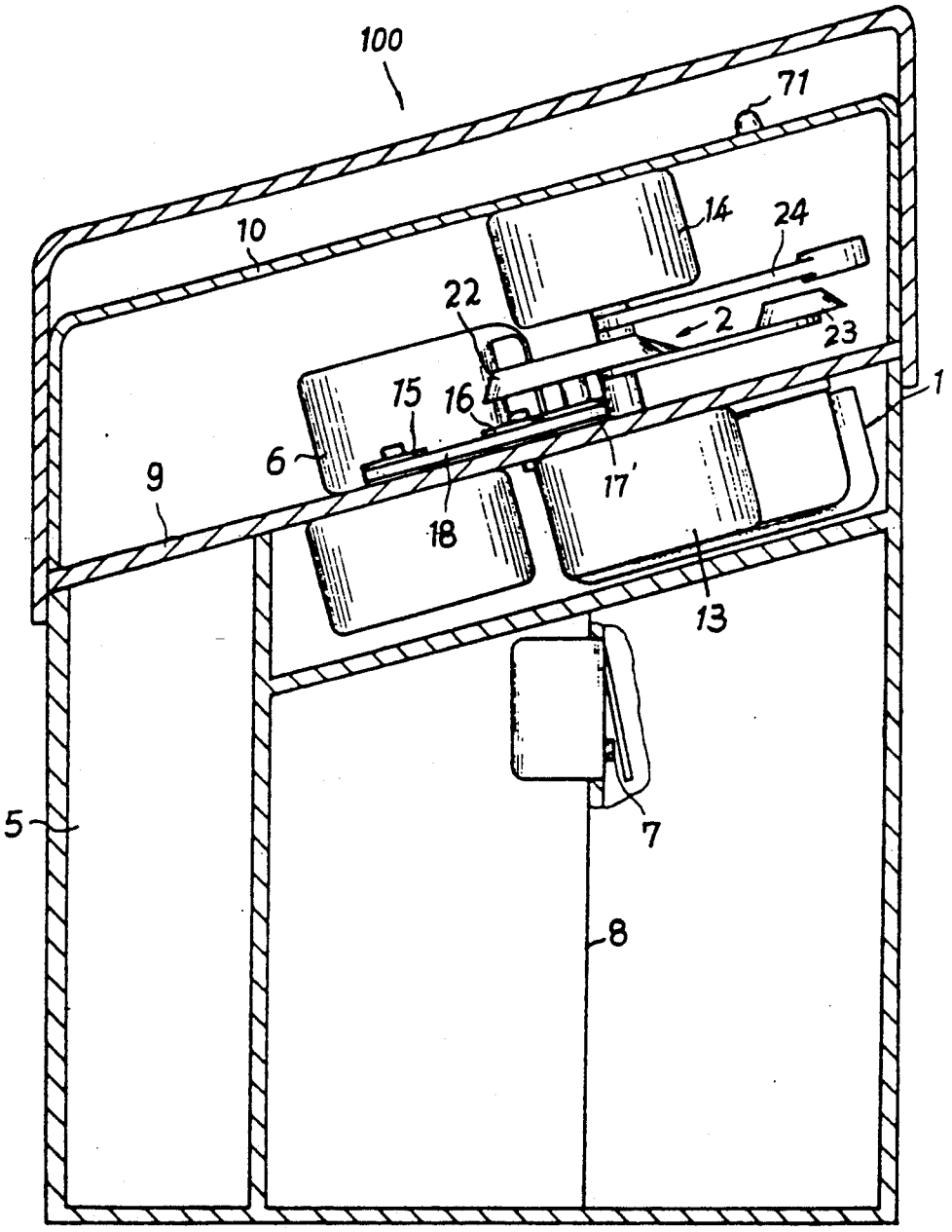
FIG. 3 is a sectional side view of the automatic ampoule-cutter.

Please now refer to FIG. 3. The ampoule cutter 100 of this invention includes a driving means 1, a cutter mechanism 2, a slant board 9, a collector 5, a fan 6 and a micro switch 7. Most of the above members are disposed on the slant board 9 and covered by a shade board 10. The micro switch 7 is disposed on an arch board 8. After the ampoule 3 is cut, the slant board 9 permits the cut off conic head of the ampoule 3 to roll down into the collector 5. The shade board 10 is used to prevent the glass chips from bounding or dropping out. Moreover, a controlling motor 14 is disposed.

Figure 4:
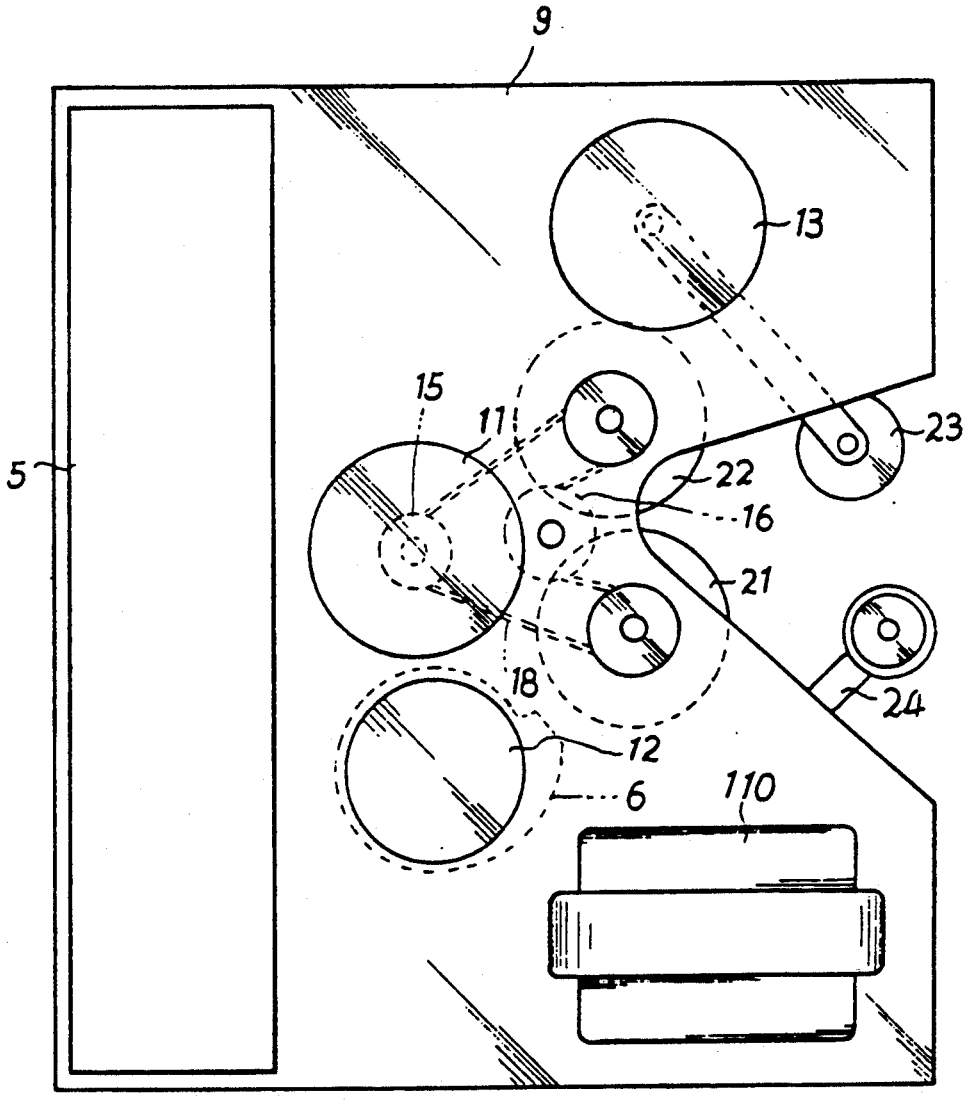
FIG. 4 is a bottom view thereof.
Figure 5:
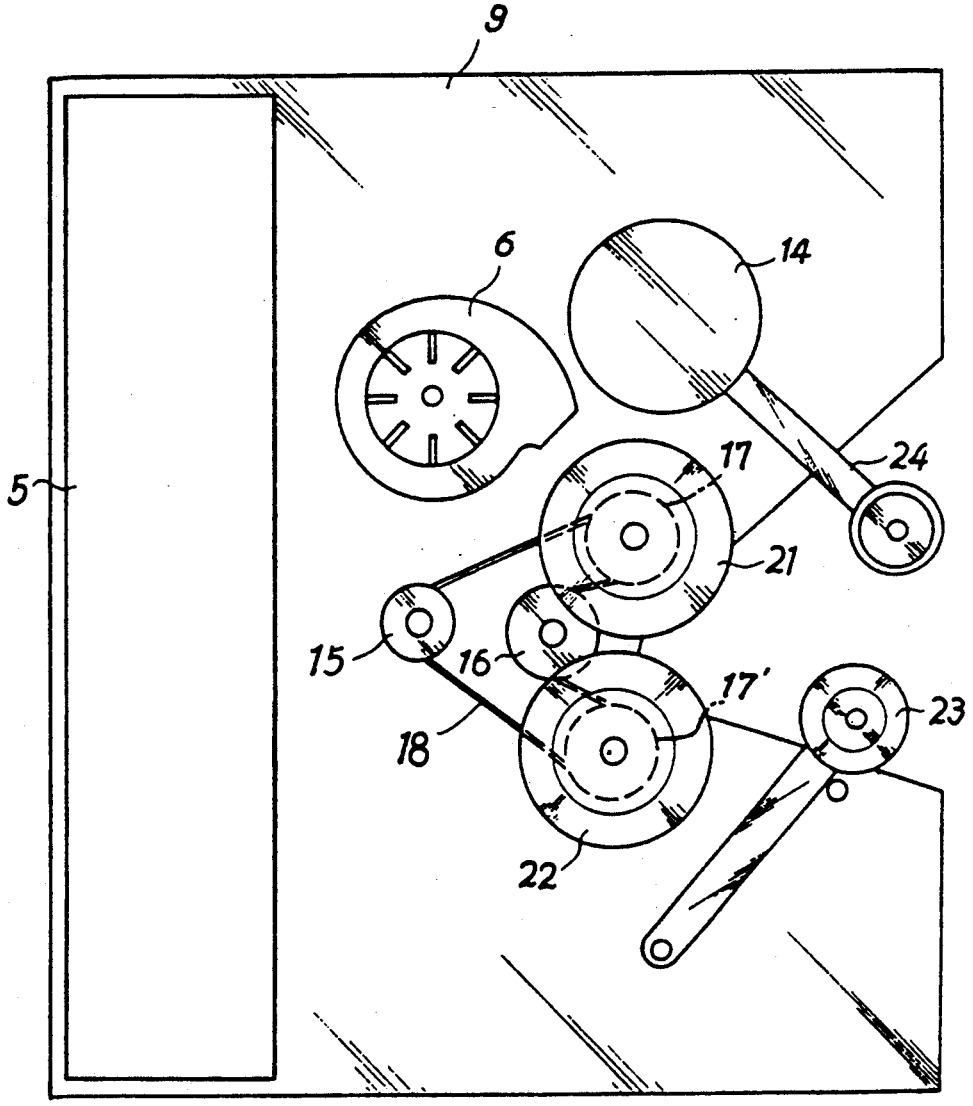
FIG. 5 is a top view showing the mechanism of the automatic ampoule-cutter.

Referring to FIGS. 4 and 5, when the cutter 100 is powered on and alternate electricity is converted into direct electricity by a commutator 110 for the cutter 100 to operate. The driving means 1 includes a driving motor 11, fan motor 12, and two controlling motors 13, 14. When the ampoule 3 is placed into the cutter 100, the micro switch 7 is touched and activated, making the power indicator 71 lighted. Also, the driving means 1 operates and the driving motor 11 transmits power to the transmitting members 15, 16, 17 and cutting member 21 and the fixing member 22 disposed on the slant board 9 via a driving belt 18. The transmitting member 16 rotates in a direction opposite to that the other three transmitting members 15, 17, 17' rotate.

Figure 6:
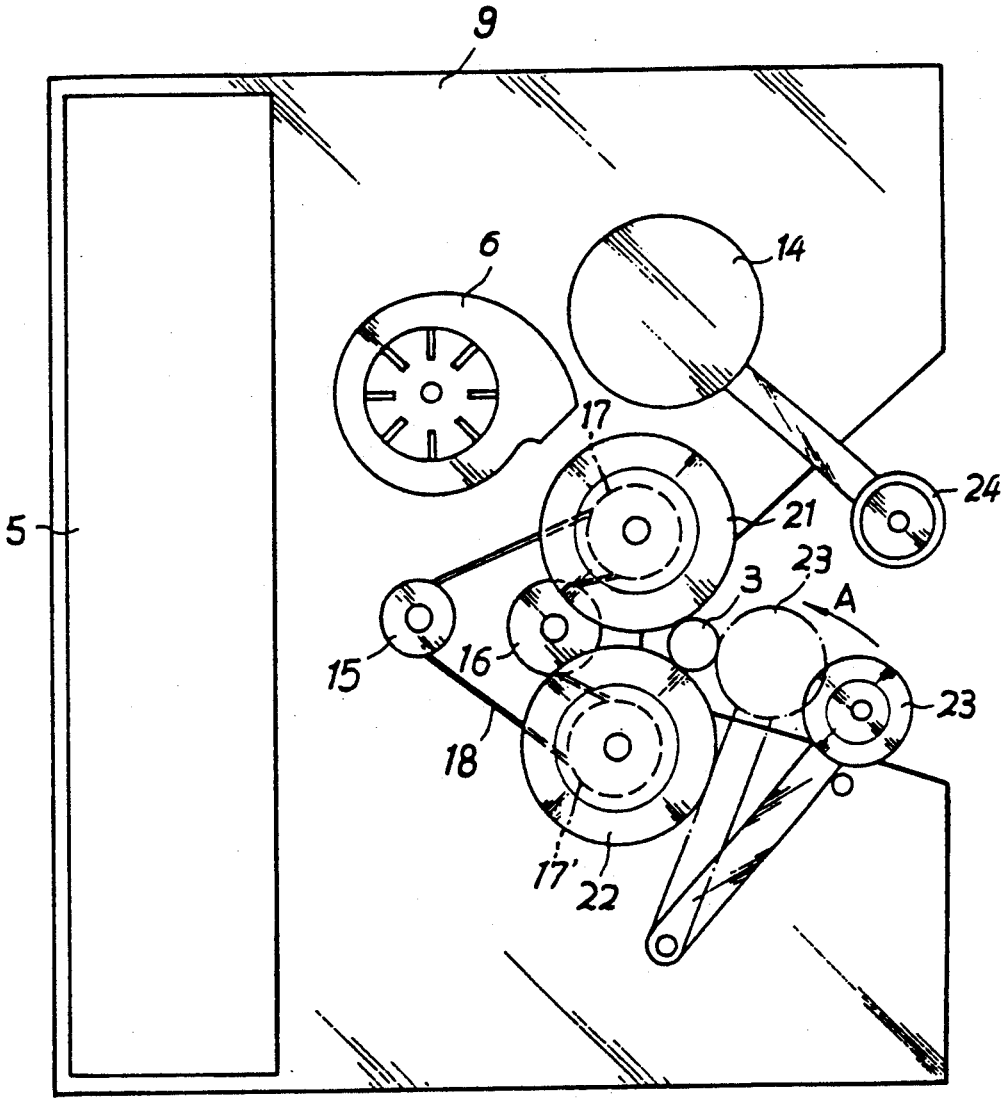
FIG. 6 shows the operation of the clamping member thereof.
Figure 7:
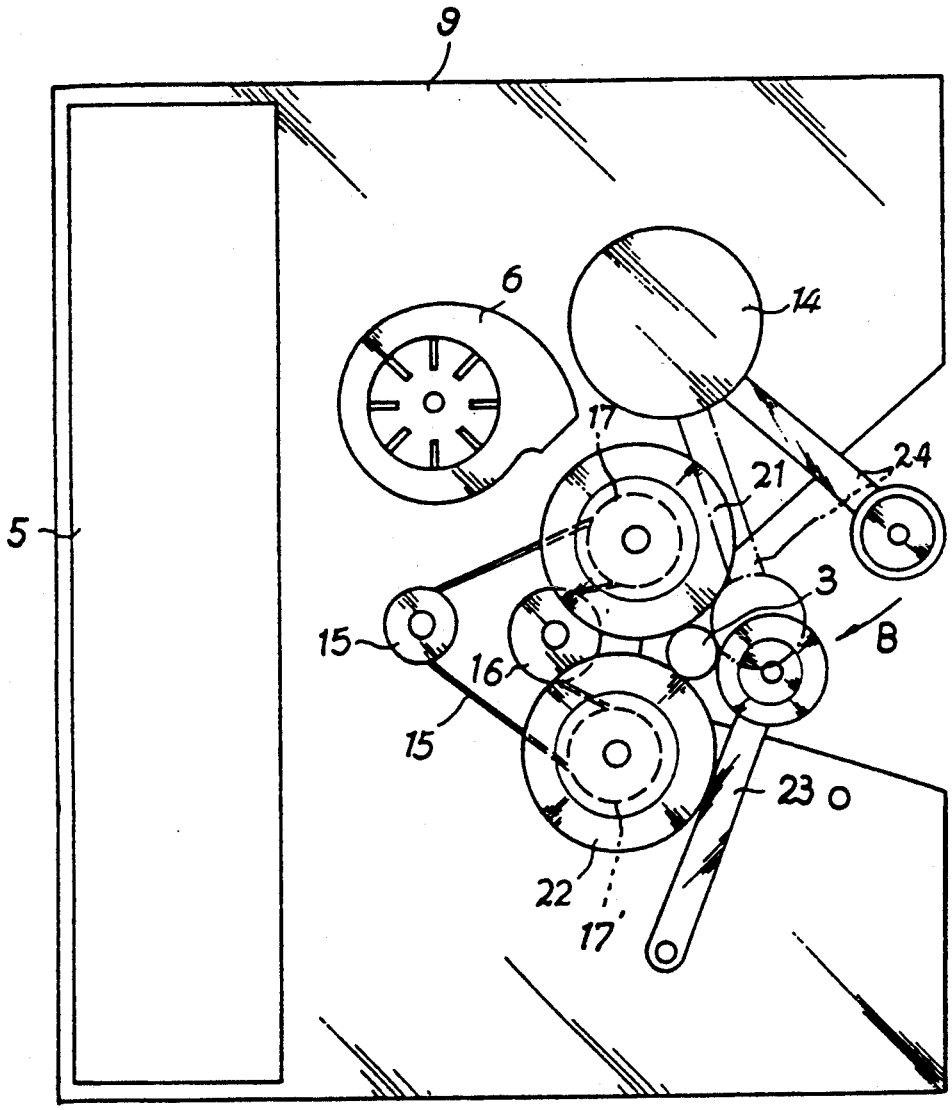
FIG. 7 shows the operation of the knocking member thereof.

Please now refer to FIGS. 5, 6 and 7, wherein the cutter mechanism 2 includes a cutting member 21, a fixing member 22, a clamping member 23 and a knocking member 24. The fixing member 22 and clamping member 23 and knocking member 24 are provided with rubber rings 25 to enhance the clamping force exerted on the ampoule 3. When the driving motor 11 is actuated to drive the transmitting members 15, 16, 17, 17' to rotate the cutting member 21 and the fixing member 22, the ampoule 3 located between the cutting member 21 and the fixing member 22 will be rotated when the ampoule 3 is rotatably clamped by the clamping member 23 which moves in arrow A direction when driven by the controlling motor 13, for several turns to cut a groove on the neck of the ampoule 3. Thereafter, the knocking member 24 is driven by the controlling motor 14 to move in arrow B direction and knock off the conic head of the ampoule 3 along the groove on the neck thereof. The shade board 10 will prevent the knocked off conic head from bounding out and make the same roll down on the slant board 9 into the collector 5.

Furthermore, the glass chips created during cutting procedure will be blown by the fan 6 into the collector 5. When "bi-bi" sound is emitted from buzzer, it is indicated that the cutting operation is completed, and the cut ampoule 3 with an opening can be taken out. Once the ampoule 3 is separated from the micro switch 7, the cutter 100 stops and the power indicator 71 is extinguished.

According to the above arrangement, the ampoule cutter of this invention is an automatic ampoule-cutter with high security. It can be placed in any place and needs no particular cleaning. The dangerous glass chips are automatically collected to prevent possible injury to persons.

What is claimed is:

1. An automatic ampoule cutter comprising:

a driving means having a driving motor, a fan motor, a first controlling motor, a second controlling motor, and a set of transmitting members driven by said driving motor;

a cutter mechanism including a cutting member and a fixing member driven by said driving motor through said set of transmitting members, a clamping member driven by said first controlling motor to be moved toward said cutting member and said fixing member for operatively clamping an ampoule, which is pre-inserted in between said cutting member and said fixing member, whereby upon a driving of said driving motor and said first controlling motor, said ampoule is rotatably clamped by said cutting member, said fixing member and said clamping member prior to having a groove cut thereon by said cutting member, and a knocking member driven by said second controlling motor for subsequently knocking off a head portion of said ampoule along said groove formed on said ampoule after being cut by said cutting member;

a fan operatively driven by said fan motor for blowing off glass chips which are produced when cutting the ampoule; and said driving means, said cutter mechanism and said fan mounted on a slant board for rolling down a cut head portion of the ampoule and glass chips cut from the ampoule along said slant board to be collected by a collector.

* * * * *